United States Patent [19]

Zecman

[11] Patent Number: 4,926,926

[45] Date of Patent: May 22, 1990

[54] THREE LAYER SHOT SLEEVE ASSEMBLY

[76] Inventor: Kenneth P. Zecman, 46520 Strathmore, Plymouth, Mich. 48170

[21] Appl. No.: 279,924

[22] Filed: Dec. 5, 1988

[51] Int. Cl.[5] ..... B22D 17/10

[52] U.S. Cl. ..... 164/312; 164/138

[58] Field of Search ..... 164/138, 312–318

[56] References Cited

U.S. PATENT DOCUMENTS

| | | | |
|---|---|---|---|
| 3,515,203 | 6/1970 | Parlanti et al. | 164/312 |
| 3,533,464 | 10/1970 | Parlanti et al. | 164/312 |
| 3,672,440 | 6/1972 | Miura et al. | 164/312 |
| 4,623,015 | 11/1986 | Zecman | 164/312 |
| 4,635,851 | 1/1987 | Zecman | 239/133 |

FOREIGN PATENT DOCUMENTS

| | | | |
|---|---|---|---|
| 278208 | 8/1988 | European Pat. Off. | 164/312 |

*Primary Examiner*—Richard K. Seidel
*Assistant Examiner*—Edward A. Brown
*Attorney, Agent, or Firm*—Krass & Young

[57] ABSTRACT

A three-layer shot sleeve assembly for transferring molten metals to a die and method of making same. A copper layer is welded onto a steel inner barrel leaving a region at each end of the inner sleeve upcoppered. A high yield strength outer shell is shrink fitted onto the coppered inner barrel. The two steel layers are welded together at the two ends. The steel outer shell is more massive and stronger than the inner barrel and serves to hold the inner barrel straight until excessive heat build up in the region opposite the well area is dissipated by the copper layer and transferred to the outer shell.

13 Claims, 1 Drawing Sheet

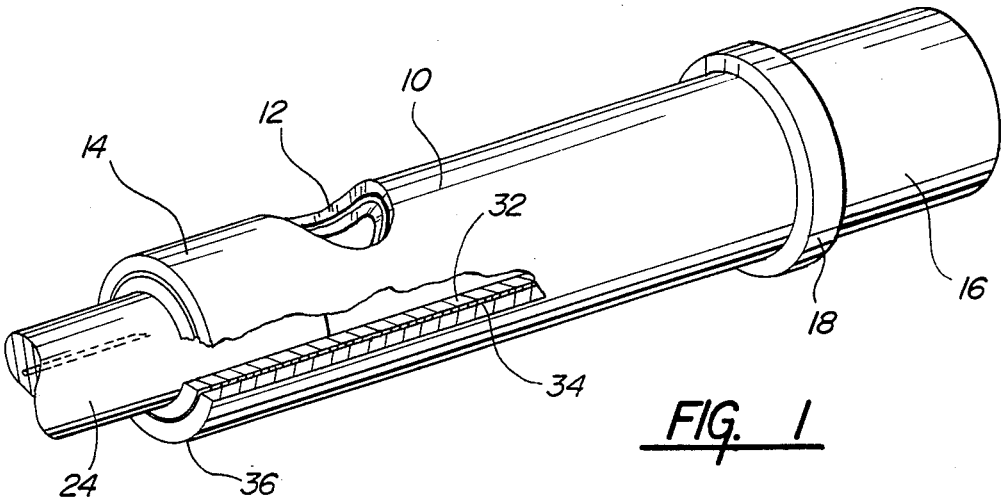
FIG. 1
FIG. 2
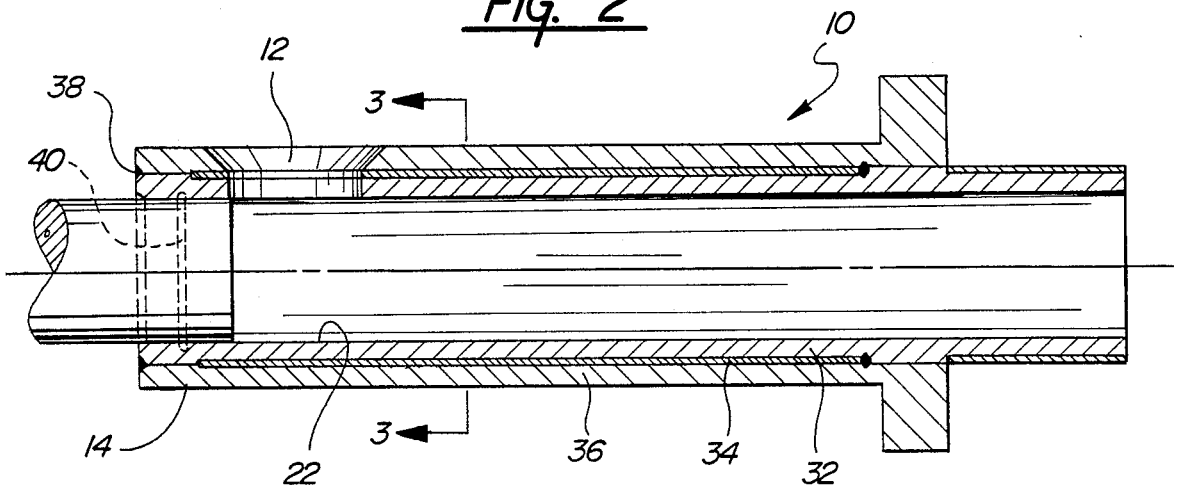
FIG. 3
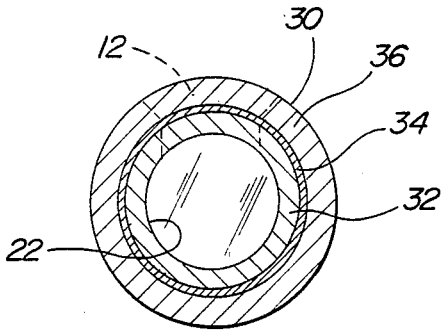

THREE LAYER SHOT SLEEVE ASSEMBLY

BACKGROUND OF THE INVENTION

1. Field of the Invention

The present invention relates to an apparatus for molding non-ferrous molten metals and, more particularly, to an improved, three-layer shot sleeve assembly.

2. Background of the Invention

A shot sleeve is a device for injecting molten metal into a die or mold. Relatively simple in construction, it typically comprises a metal cylinder defining an axial chamber and a piston fitted within the chamber to act as an injection ram. An aperture in the side of the sleeve opens into a portion of the cylinder chamber just in front of the piston when it is in the rest position. This portion of the chamber is called the "well" and the molten metal is poured into the well for temporary residence before the piston is actuated.

Because of the high temperature difference between the molten casting metal and the elements of the shot sleeve, useful life expectancy of prior art devices is quite short. This is believed to be due in part to warpage and erosion of the axial chamber, and resulting piston wear. The surface of the bore opposite the well is subjected to the highest temperature. By the time molten metal has entered the rest of the bore, it has cooled and is much less damaging. The temperature differential from the top to the bottom in a horizontal sleeve creates warpage in the sleeve.

This problem of warpage and erosion is exacerbated when the shot sleeve is used at higher casting rates or with metals having a high melting point. While aluminum has a lower melting point than, for example, steel or iron, aluminum has a much higher rate of heat transfer (approximately five times as high as steel or iron). The cycle for casting aluminum is much shorter than that for steel or iron and, consequently, many more pounds of aluminum may be cast per hour than is the case with the other metals. Hence, many more BTU's are transferred per hour to the shot sleeve than is the case with ferrous metals. Since the casting cycle is shorter and the heat transfer rate is higher, conducting the damaging heat away from the pour hole area must be done in a much shorter time, and thus, efficient heat transfer is very important.

Efforts have been made to increase the useful life of a shot sleeve by a variety of methods, such as water cooling the sleeve itself. In Parlanti U.S. Pat. No. 3,533,464, a plurality of radially extending, heat dissipating fins are disposed about the periphery of the injection chamber of the shot sleeve. Parlanti et al. U.S. Pat. No. 3,515,203, discloses a laminated injection cylinder particularly useful for die casting high temperature molten metals, such as iron or steel. An inner sleeve formed of a super alloy is surrounded by an intermediate layer of beryllium copper alloy, which is in turn enclosed by an outer shell comprises of heat treated H-13 steel. The intermediate beryllium copper layer extends all the way to the die end of the shot sleeve chamber. This laminated shot sleeve relies solely on heat transfer from the inner layer to the outer layer by the intermediate layer to prevent excessive heat build-up in the well area of the shot sleeve.

Miura et al. U.S. Pat. No. 3,672,440 discloses an injection cylinder useful in the die casting of ferrous and other metals of high melting points. The injection cylinder, which is inclined with respect to the horizontal, comprises an outer cylindrical sleeve of high heat conductivity and an inner cylindrical lining which is removably fitted in the outer sleeve. The inner lining includes a plurality of cylindrical sections of short axial length which are clamped together. If any of the sections become warped or otherwise damaged during molding operations, the damaged section may be removed and replaced.

While the systems disclosed by Parlanti et al. and Miura et al. may be useful for casting metals having high melting points, neither system is totally satisfactory for use in casting metals having low melting temperatures, such as aluminum or magnesium. The beryllium copper layer in the Parlanti et al. device extends all the way to the die end of the shot sleeve, this end of the sleeve is held in place by the die. The end of the sleeve fitted into the die expands as heat is absorbed by the steel sleeve. Typically, an aluminum biscuit, which cushions the impact of the piston as the piston packs the molten metal into the die, forms at the die end of the sleeve. Hence, during rapid cycling, the two ends of the shot sleeve are heated at a much faster rate than the middle of the sleeve. The sleeve at the die end of Parlanti et al.'s sleeve would expand much more than the middle, causing the fit between the piston and the sleeve to change drastically.

Similarly, the short cycle time and high heat transfer typical of aluminum casting negates the usefulness of Muira's shot sleeve when applied to low melting point metal with high heat transfer capability, such as aluminum or magnesium casting. Since the beryllium copper sections comprising the inner liner are removable, they necessarily cannot be fitted tightly within the outer shell. The rate of transfer of heat from the hot inner sleeve to the outer shell is, necessarily, compromised.

In my U.S. Pat. No. 4,623,015 I disclose an improved shot sleeve for molding molten metals which has a surface pattern of copper welded to the outside of the metal body of the shot sleeve. The spiral pattern of the welded copper is designed to passively convey heat away from the well area.

While the device disclosed in my above-cited U.S. patent has found some commercial acceptance, it has certain shortcomings. Since the copper is disposed on the outside surface of the shot sleeve, it is relatively far away from the hot metal and heat transfer is, thus, impaired. Certain shot sleeves which are components with standard die casting machines have sleeve walls of a relatively great thickness, thus exacerbating the problem.

It would be desirable to provide a shot sleeve assembly more useful for lower melting point metals with high heat transfer capability such as aluminum and magnesium. These are casting operations in which heat is rapidly transferred to the steel sleeve. Therefore it would be desirable to transfer the damaging heat away rapidly and prevent any prolonged temperature imbalance within the sleeve which results in elastic deformation and erosion of the sleeve at the pour hole or well.

It would be particularly desirable to provide such a shot sleeve assembly adaptable for use with systems in which a shot sleeve cylinder has a relatively thick sleeve wall.

SUMMARY OF THE INVENTION

Disclosed and claimed herein is a shot sleeve assembly having a novel three-layer construction designed for moving molten metal into a mold cavity. The shot sleeve assembly includes an elongated shot sleeve which has a bore extending axially therethrough from a first, or shot, end to a second, or die, end adapted to be positioned adjacent to the mold cavity. A well opening extends through a side wall of the sleeve at a location adjacent the first end. An injection piston is slidably mounted in said bore for reciprocal motion therein.

The three-layer shot sleeve includes an inner barrel extending the length therein which is, preferably, comprised of X-100 which has a higher than average heat transfer rate for steel. Welded, brazed or otherwise fused onto the outer diameter of the barrel is a layer formed of commercially pure copper. Unlike the inner barrel, this layer does not extend the full length of the shot sleeve. It commences at a point between or medial the shot end and the well and terminates at a point proximate and spaced from the second, or die, end of the shot sleeve. An outer shell formed of heat treated alloy steel is shrink fit onto the two-layer assembly formed by the inner barrel and outer layer. Unlike the inner barrel, the outer shell extends only to the collar or approximately 60% to 75% the length of the barrel. The mass of the outer shell is substantially greater than that of the inner barrel. The yield strength of the outer shell is also substantially greater than that of the inner barrel due to heat treatment.

Shrink fitting the outer shell onto the inner barrel and outer layer assembly confers several advantages. The copper layer is compressed by the outer shell and is, thus, held in tight contact therewith, thereby improving heat transfer rate as well as affording a heat sink or place to dump the excess heat. The outer shell, which is held under tension and has a greater mass and yield strength than the inner barrel, serves also to hold the inner barrel rigid and prevent the shot sleeve assembly from warping excessively. This effect is heightened by the fact that the copper layer does not extend to both ends of the shot sleeve assembly The two steel layers contact each other at both ends and are welded together. This increases the rigidity of the shot sleeve assembly and prevents deformation during repeated cycling.

BRIEF DESCRIPTION OF THE DRAWINGS

The following detailed description may best be understood by reference to the following drawings in which:

FIG. 1 is a perspective view of the shot sleeve apparatus of the present invention;

FIG. 2 is a partial longitudinal section view of the shot sleeve shown at FIG. 1; and FIG. 3 is a cross section view of the apparatus shown in FIG. 1.

DETAILED DESCRIPTION OF THE PREFERRED EMBODIMENTS

In the following detailed description, like reference numerals are used to refer to the same element of the invention shown in multiple figures thereof.

Referring now to the drawing, and in particular to FIG. 1, the shot sleeve of the present invention includes a hollow, substantially cylindrical body 10 having a side opening well 12 mediate a first, or shot, end 14 and an second, or die, end 16 fitted, in this case, with a mounting collar 18 which abuts a casting machine platen (not shown) when installed. Sleeve 10 is bored through to form an axial passage 22 which receives a piston 24. Well 12 is adjacent the face of the piston 24 in its rest position. After molten metal is poured into the well 12, the piston 24 is actuated by suitable means to displace the molten metal longitudinally through the bore 22 and into a casting die (not shown) in a conventional fashion.

In actual practice, molten metal is poured from a ladle into well 12. The well opening may be circular or oval.

The temperature of the molten metal should be sufficiently high above the freezing point thereof as to minimize the chance of premature freezing due to the die casting operation. On the other hand, the temperature of molten metal in the ladle should not be excessively high; otherwise, unnecessary contraction will occur during the liquid cooling and resultant solidification process. For example, in the case of molten aluminum, the temperature of the melt should be about 1250° F.

Having been introduced into the shot sleeve 10 from well 12, the molten metal will then radiantly, convectively, and conductively dissipate a high amount of thermal energy. Unless such dissipation occurs in a controlled manner, frequent and expensive replacement of the piston 24 is necessary. Down time in repairing the shot sleeve piston is expensive since capital equipment and manpower stands idle.

In accordance with the invention, excessive heat is passively carried away from the well 12 by means of a copper outer layer 34 which is welded to an inner barrel 32. As may be clearly seen in FIGS. 1 and 2, copper layer 34 does not extend the full length of the shot sleeve 10 but, rather, commences at a point between or mediate the shot end 14 and the well 12 and terminates at a point proximate the collar 18. The outer copper layer 34 extends approximately 30% to 60% of the total length of the shot sleeve, and is always located directly beneath the well 12. The copper layer 34 may, however, extend forward from a location rear of the well 12 to the die end 16. Outer shell 36, which is held under tension, encloses both inner barrel 32 and copper outer layer 34. Outer shell 36 is attached to inner barrel 32 from shot end 14 to collar 18 of shot sleeve 10 by means of welds 38,39. Outer shell 36 extends approximately 60% to 75% cf the length of shot sleeve 10, but in some cases can extend to die end 16. A lubrication groove 40 is also provided.

Preferably, the inner barrel 32 is fabricated from a steel having good heat transfer capabilities such as PCX or X-100 steel, which has approximately 15% better heat conductivity than material such as H-13 or higher alloy tool steels. This allows quicker heat transfer to the copper outer layer 34.

Preferably, the inside diameter of the outer shell 36 is several thousandths of an inch smaller than the outside diameter of the inner barrel 32. After the copper outer layer 34 is welded to the inner barrel 32, the outer shell 36 is first heated until it expands sufficiently to fit over the welded unit. The outer shell 36 is then fitted over inner barrel 32 and copper layer 34. As outer layer 36 cools, it shrinks onto inner barrel 32 leaving the inner barrel in compression.

Copper has an expansion rate that is approximately 50% greater than that of steel. It also transfers heat at a rate almost ten times faster than steel. Shrink fitting of outer shell 36 onto inner barrel 32 traps copper layer 34 in a limited area between the two steel layers 32,36. As inner barrel 32 is heated with molten metal during the casting process, it transfers its heat first to copper layer 34. Due to copper's much higher rate of heat transfer, the heat transfer to copper layer 34 will first travel throughout the entire copper layer 34 before it is subsequently transferred to outer shell 36. This heat exchange helps ensure that outer shell 36 will be heated much more uniformly than inner barrel 32. By providing outer shell 36 more massive and of greater strength than inner barrel 32, outer shell 36 serves as a sort of straitjacket to minimize warping of the shot sleeve.

Copper layer 34 is contained at both its ends by the steel-to-steel welded construction. During cycling, unevenly heated inner barrel 32 will warp while outer shell 36 stays straight. If copper layer 34 were not contained at both ends, the warping of inner barrel 32 would squeeze the malleable copper out from between the two steel layers 32,36.

By acting as a mechanical straitjacket, the outer shell 36 holds unevenly heated barrel 32 rigid for several seconds. While shot sleeve 10 does still warp, this warpage occurs only after the molten metal has been delivered into the die with the piston 24. Because there are several seconds between injection cycles, copper layer 34 has time to transfer the heat more evenly, thus allowing the shot sleeve 10 to come back to a straight position. The ambient heat held in the mass of shot sleeve 10 is now distributed therethroughout, from top to bottom and from end to end.

While the herein invention has been described with reference to certain embodiments and exemplifications thereof, it is contemplated that other designs and arrangements of the herein claimed elements may become obvious to one skilled in the art without departing from the scope of the present invention which is defined by the claims appended hereto.

I claim:

1. A shot sleeve assembly for moving molten metal into a mold cavity, said assembly comprising:

an elongated shot sleeve having a bore extending axially therethrough from a first end to a second end adapted to be positioned adjacent the mold cavity;

a well opening extending through a side wall of said sleeve at a location adjacent said first end; and an injection piston slidably mounted in said bore, wherein the shot sleeve includes:

an inner barrel extending the length thereof;

an intermediate layer of high thermal conductivity material disposed around, secured to and covering substantially the entire outer surface of the inner barrel commencing at a point medial of the first end and the well and terminating at a point proximate and spaced from the second end to form a two-layer assembly; and a high yield strength outer shell enclosing under compression said two-layer assembly, extending beyond the terminal ends of said two-layer assembly and being secured to the inner barrel to envelop and trap said intermediate layer, said outer shell having a mass and a yield strength substantially greater than that of said inner barrel.

2. The shot sleeve assembly of claim 1 wherein the intermediate layer is formed of copper.

3. The shot sleeve assembly of claim 1 wherein the intermediate layer is fused on the inner barrel.

4. The shot sleeve assembly of claim 1 wherein the outer shell is shrink fit onto the two-layer assembly.

5. The fused shot sleeve assembly of claim 1 wherein the outer shell is welded to the inner barrel at the first and second ends.

6. The shot sleeve assembly of claim 1 wherein the outer shell is comprised of a heat treated steel alloy.

7. The shot sleeve assembly of claim 1 wherein the inner barrel is comprised of a steel with good heat transfer capability.

8. In a shot sleeve assembly of the type which comprises a metal body having first and second ends, an axial bore extending between said ends, a radial bore defining a well mediate said ends and in fluid communication with said axial bore, and a piston disposed within said axial bore and reciprocal relative to said body for displacing molten metal from said well toward said second end, the improvement wherein:

the metal body is a three-layer assembly including:

an inner barrel extending the length thereof;

a continuous intermediate layer of high thermal conductivity material fused to and around substantially the entire outer surface of the inner barrel commencing at a point medial of the first end and the well and terminating at a point spaced from the second end to form a two-layer assembly; and a high yield outer shell enclosing under compression said two-layer assembly, extending beyond the terminal ends of said twolayer assembly and being joined to the outer surface of said inner barrel to envelop and to trap said high thermal conductivity material, said outer shell having a mass and a yield strength substantially greater than that of said inner barrel.

9. The shot sleeve assembly of claim 8 wherein the intermediate layer is formed of copper.

10. The shot sleeve assembly of claim 8 wherein the outer shell is shrink fit onto the two-layer assembly.

11. The shot sleeve assembly of claim 8 wherein the outer shell is comprised of a heat treated steel alloy.

12. The shot sleeve assembly of claim 8 wherein the inner barrel is comprised of a steel with good heat transfer capability.

13. A shot sleeve of the type which includes a tubular body having an axial bore for a displaceable piston and a pour hole for loading the bore within molten metal wherein the improvement comprises:

a body construction having a relatively low strength inner barrel, an intermediate layer of copper over substantially the entire outer surface of and secured to the inner barrel with axial opposite ends within and spaced inwardly from the opposite ends of the inner barrel, and a relatively high strength outer sleeve over and compressively contacting the intermediate layer; said outer sleeve extending beyond the ends of the intermediate layer and being secured to the outer surface of the inner barrel to envelop and trap the intermediate layer.

* * * * *